US005178556A

United States Patent [19]

Chen

[11] Patent Number: 5,178,556

[45] Date of Patent: Jan. 12, 1993

[54] COMPUTER PLUG CONNECTOR FASTENING MECHANISM

[75] Inventor: John Chen, Hsien Tien, Taiwan

[73] Assignee: Advanced-Connectek Inc., Taipei Hsien, Taiwan

[21] Appl. No.: 782,182

[22] Filed: Oct. 24, 1991

[51] Int. Cl.[5] ..... H01R 13/627

[52] U.S. Cl. ..... 439/357

[58] Field of Search ..... 439/350, 351, 357, 358, 439/352, 347, 345, 372, 354, 607, 610

[56] References Cited

U.S. PATENT DOCUMENTS

| | | | |
|---|---|---|---|
| 2,183,651 | 12/1939 | Langston et al. | 439/353 |
| 3,566,336 | 2/1971 | Johnson et al. | 439/353 |
| 4,936,793 | 6/1990 | Uchida | 439/357 |
| 4,941,849 | 7/1990 | Fujiura | 439/357 X |
| 4,961,711 | 10/1990 | Fujiura et al. | 439/357 |

*Primary Examiner*—Larry I. Schwartz
*Assistant Examiner*—Khiem Nguyen
*Attorney, Agent, or Firm*—Varndell Legal Group

[57] ABSTRACT

A computer plug connector fastening mechanism comprising two rectangular frames formed in the outer shell of a computer plug connector at two opposite sides with two clamp holders respectively fastened therein to hold two clamping devices which are inserted therethrough for clamping the computer plug connector to a computer plug socket, wherein said clamp holders each has a front edge stopped at an inward flange on either of said rectangular frames and two hooked portions respectively engaged into two elongated grooves on the inner wall surface of either of said rectangular frames; said clamping devices each is comprised of a metal clamping plate coupled with a plastic knob for convenient finger operation, which metal clamping plate has a unitary hook hooked in a rectangular hole on either of said clamp holder when inserted through either of said rectangular frames. The plastic knob of each clamping device has a curved leaf spring attached thereto and stopped against the peripheral wall surface of the computer plug connector so that the two clamping devices can be squeezed and released so as to secure the computer plug connector to a computer plug socket or release it therefrom.

1 Claim, 5 Drawing Sheets

COMPUTER PLUG CONNECTOR FASTENING MECHANISM

BACKGROUND OF THE INVENTION

The present invention relates to a computer plug connector fastening mechanism and relates more particularly to such a computer plug connector fastening mechanism for securing a computer plug connector to a computer socket connector.

FIG. 1 illustrates a computer plug connector fastening mechanism which was invented by the present inventor and is comprised of two unitary clamp holders made on the metal casing of the connector, which is covered within a plastic outer shell, and two clamping elements fastened in said two clamp holders. Squeezing the two clamp holders inwards causes the two clamping elements to relatively extend outward, and therefore, the clamping elements on the computer plug connector can be hooked up with the clamping elements on the computer socket connector to which the computer plug connector is connected. The main disadvantage of this structure of computer plug connector fastening mechanism is its expensive manufacturing cost. FIG. 2 illustrates another structure of computer plug connector fastening mechanism which was also invented by the present inventor. In this structure of computer plug connector fastening mechanism, there are provided two clamping devices respectively attached to the plastic outer shell which is directly molded on the metal casing of the plug connector. The two clamping devices each has a unitary tubular portion transversely made at the middle of the metal clamping plate thereof through the process of punching for securing to a groove on the plastic outer shell. The main disadvantage of this structure of computer plug connector fastening mechanism is that the two clamping devices may get loosened easily causing fastening problem. Another disadvantage of this structure of computer plug connector fastening mechanism is that the clamping devices provide less spring force for clamping operation because they are attached to the plastic outer shell but not the metal casing of the computer plug connector. Further, while squeezing the clamping devices for fastening the computer plug connector to a computer socket connector, the plastic outer shell may be damaged easily.

SUMMARY OF THE INVENTION

The present invention has been accomplished to eliminate the aforesaid disadvantages. According to one aspect of the present invention, a computer plug connector fastening mechanism is generally comprised of two rectangular frames formed in the plastic outer shell of a computer plug connector during the forming process of the plastic outer shell, two metal clamp holders fastened in said two rectangular frames through plug-in connection for holding two clamping devices. According to another aspect of the present invention, the clamping devices each has a hook on a projecting strip which when inserted into either of the two rectangular frames on the plastic outer shell of the computer plug connector automatically hooks in a rectangular hole on either metal clamp holder. According to still another aspect of the present invention, the clamping devices each has a curved leaf spring on the plastic knob thereof stopped against the peripheral wall surface of the computer plug connector so that the clamping operation of the clamping devices can be effectively operated.

DETAILED DESCRIPTION OF THE PREFERRED EMBODIMENT

Figure 1:
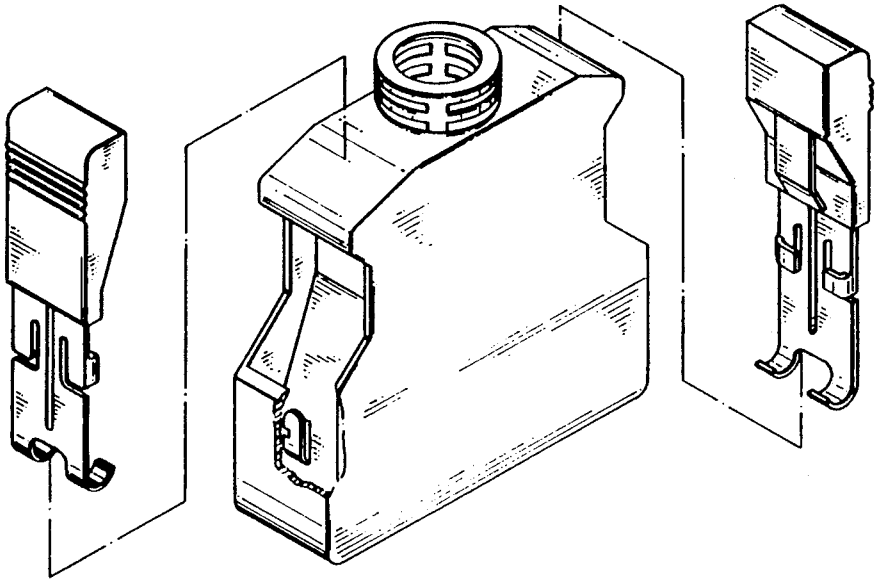
Fig 1 PRIOR ART
FIG. 1 is a dismantled elevational view of a prior art computer plug connector fastening mechanism.
Figure 2:
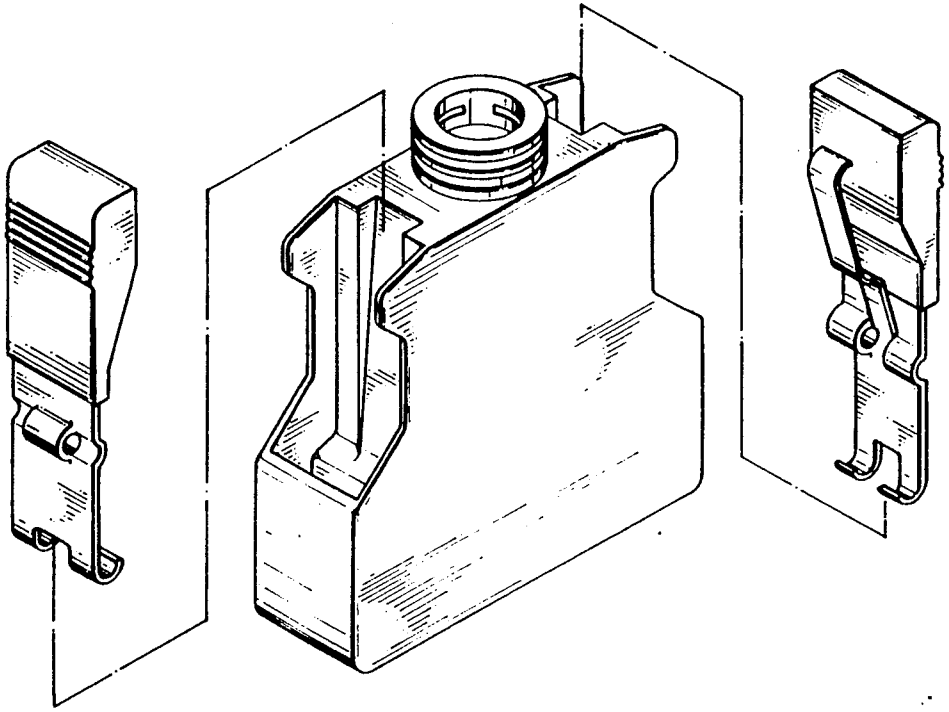
Fig 2 PRIOR ART
FIG. 2 is a dismantled elevational view of another prior art computer plug connector fastening mechanism.
Figure 3:
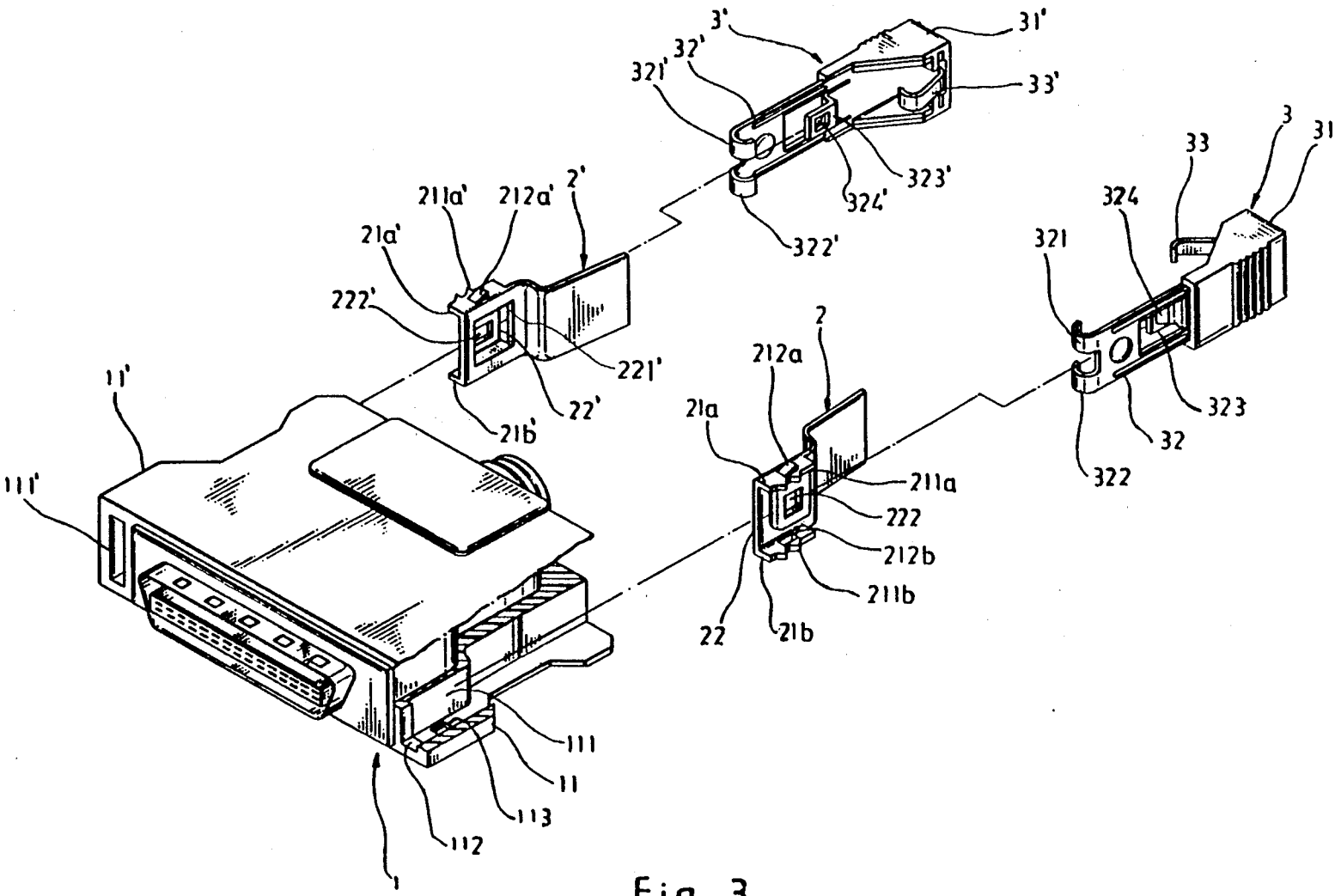
FIG. 3 is an exploded perspective view of the preferred embodiment of the present invention.
Figure 4:
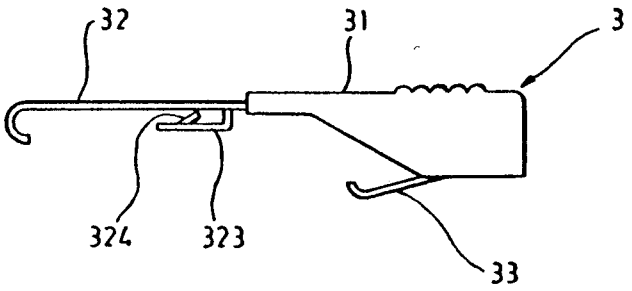
FIG. 4 is a side view of a clamping device as constructed according to the present invention.
Figure 5:
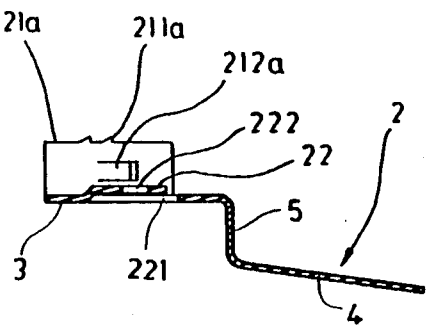
FIG. 5 is a sectional side view of a clamp holder as constructed according to the present invention.

Referring to FIG. 3, a computer plug connector as constructed in accordance with the present invention is generally comprised of a connector 1, two clamp holders 2, 2', and two clamping devices 3, 3', wherein the connector 1 is comprised of a plastic outer shell directly molded on a casing defining therein two hollow, rectangular frames 11, 11' at two opposite lateral sides. The rectangular frames 11, 11' each defines therein a rectangular slot 111 or 111' and has an inward flange 112 or 112' around said rectangular slot 111 or 111' at the front end and two elongated grooves 113, one of which is shown in the bottom surface of the slot, a similar groove being provided in the top surface of the slot. Each clamp holder 2 or 2' is of similar construction and as seen in FIG. 5 has a cross-sectional configuration including opposite end portions 3 and 4 and a connecting portion 5 which forms a generally right angle with end portion 3 and an obtuse angle with end portion 4. The clamp holders include parallel side walls 21*a*, 21*b* or 21*a'*, 21*b'* extending substantially perpendicular to one end portion thereof, these side walls having toothed portions 211*a* and 211*b* or 211*a'* and 211*b'* on the edges thereof. The side walls also have hooked portions 212*a* and 212*b* or 212*a'* and 212*b'* extending obliquely therfrom and formed by a punching process. The clamp holders also include at said one end portion thereof rectangular raised portions 22, 22' disposed between the side walls thereof. Raised portions 22, 22' have rectagular holes 222 and 222' forward therethrough, and plug holes 221 and 221' are formed in said one end portion of the clamps holders and are in communication with holes 222 and 222' respectively. Each clamping device 3 or 3' comprises a plastic knob 31 or 31' having a metal clamping plate 32 or 32' at one end and a curved leaf spring 33 or 33' at an opposite end, wherein the metal clamping plate 32 or 32' has two unitary hooks 321, 322 or, 321', 322' at the front end thereof and a unitary L-shaped projecting strip 323 or 323' at the middle formed through the process of punching, which L-shaped projecting strip 323 or 323' has a unitary hook 324 or 324 formed thereon at an outer side through the process of punching (see also FIG. 4).

Figure 6:
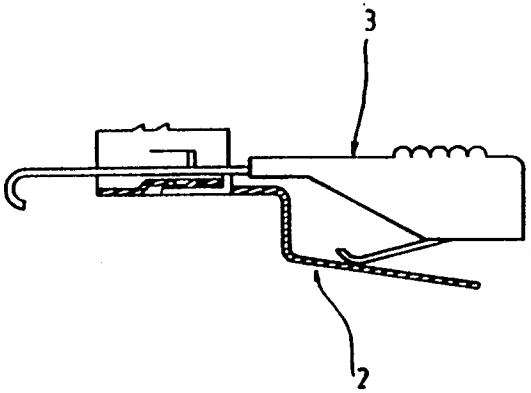
FIG. 6 is a side view of the clamp holder and the clamping device when they are connected together.
Figure 7:
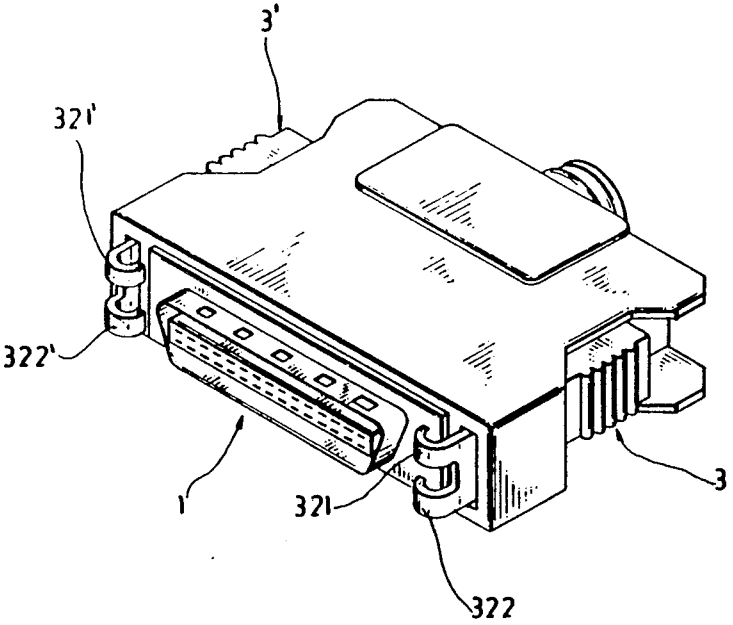
FIG. 7 is an elevational assembly view of the preferred embodiment of the present invention.

The assembly process of the present invention is quite simple. The two clamp holders 2, 2' are respectively inserted into the two rectangular slots 111, 111' in the connector 1 with each front end respectively stopped against the inward flange 112 or 112' permitting the hooked portions 212*a*, 212*b*, 212*a'*, 212*b'* to be respectively engaged into the elongated grooves 113. At the same time, the toothed portions 211*a*, 211*b*, 211*a'*, 211*b'* are respectively engaged into the inner wall surfaces of the rectangular frames 11, 11'. Therefore, the two clamp holders 2, 2' are firmly fastened in the rectangular slots 111, 111' and prohibited from moving forward or backward. After the two clamp holders 2, 2' have been fastened in the connector 1, the metal plates 32, 32' of the two clamping devices 3, 3' are respectively inserted into the rectangular slots 111, 111' with the L-shaped projecting strips 323, 323' respectively inserted into the plug holes 221, 221' on the raised portions 22, 22' permitting the hooks 324, 324' of the L-shaped projecting strips 323, 323' to respectively insert into the rectangular holes 222, 222' and hook therein (see FIG. 6), and therefore, the clamping devices 3, 3' become respectively secured to the two clamp holders 2, 2' inside the two opposite rectangular frames 11, 11' of the connector 1 (see FIG. 6).

I claim:

1. In a computer plug connector of the type having a plastic outer shell directly molded on a casing, comprising:

an outer shell having two hollow, rectangular frames formed therein at two opposite lateral sides, said rectangular frames each defining therein a rectangular slot having inner walls and having an inward flange around said rectangular slot at the front end thereof and two elongated grooves on the internal top and bottom surfaces thereof;

two clamp holders respectively fastened in said frames, said clamp holders each comprising a metal clamping plate having opposite end portions and including parallel side walls extending substantially perpendicular to one of said end portions, each of said side walls having toothed portions on the edges thereof engaging one of said inner walls, said side walls also including hooked portions extending therefrom and disposed within the grooves formed in said slots, each of said metal clamping plates also including at said one end portion a raised portion disposed between said side walls, said raised portion having a hole formed therethrough, said one portion also having a plug hole formed therethrough in communication with said hole in the raised portion; and two clamping devices respectively inserted through said slots in the rectangular frames and retained by said clamp holders, said clamping devices each having opposite ends and including a metal clamping plate at one end extending through one of said slots, each clamping device also including a leaf spring at the opposite end thereof engaging the opposite end portion of one of said clamp holders, each of said clamping plates having a generally L-shaped projecting strip thereon inserted into the plug hole of one of said clamp holders, each clamping device also having a hooked portion thereon and disposed within the raised portion of one of said clamp holders.

* * * * *